US005415116A

United States Patent [19]

Nishio

[11] Patent Number: 5,415,116

[45] Date of Patent: May 16, 1995

[54] HEADGEAR HOLDING APPARATUS INCLUDING A DETACHABLE GUIDE MEMBER

[75] Inventor: Akira Nishio, Aichi, Japan

[73] Assignee: Brother Kogyo Kabushiki Kaisha, Nagoya, Japan

[21] Appl. No.: 228,719

[22] Filed: Apr. 18, 1994

[30] Foreign Application Priority Data

Apr. 27, 1993 [JP] Japan ..... 5-123527

[51] Int. Cl.[6] ..... D05C 9/04

[52] U.S. Cl. ..... 112/103

[58] Field of Search ..... 112/103, 63, 2, 121.12, 112/121.15

[56] References Cited

U.S. PATENT DOCUMENTS 3,448,707 6/1969 Thomsen ..... 112/63 X
4,628,843 12/1986 Tajima ..... 112/121.12
4,665,844 5/1987 Shibata ..... 112/103
5,167,194 12/1992 Nakagaki ..... 112/103
5,261,338 11/1993 Tajima et al. ..... 112/121.15 X
5,277,140 1/1994 Nakagaki ..... 112/103 X

*Primary Examiner*—Clifford D. Crowder
*Assistant Examiner*—Ismael Izaguirre
*Attorney, Agent, or Firm*—Oliff & Berridge

[57] ABSTRACT

A headgear holding apparatus for use with an embroidery sewing machine including a machine body having a sewing-bed arm, the apparatus including a base structure; a guiding device including a guide member, for guiding the base structure in a guiding direction; a rotatable structure supported by the base structure such that the rotatable structure is rotatable about an axis line parallel to the guiding direction; a headgear holder holding a headgear into which the sewing machine forms stitches, the headgear holder being detachably securable to the rotatable structure; and the guide member of the guiding device being detachably securable to the machine body of the sewing machine such that the guide member extends substantially parallel to the sewing-bed arm of the sewing machine.

19 Claims, 6 Drawing Sheets

HEADGEAR HOLDING APPARATUS INCLUDING A DETACHABLE GUIDE MEMBER

BACKGROUND OF THE INVENTION

1. Field of the Invention

The present invention relates to a headgear holding apparatus for use with an embroidery sewing machine.

2. Related Art Statement

There is known a multiple-needle embroidery sewing machine which produces a colorful embroidery by using a plurality of color-different embroidery threads. The sewing machine has, at a free end of a sewing-head arm thereof, a needle-bar housing in which a plurality of needle bars (and sewing needles detachably secured thereto) are accommodated in an array and which is movable in the direction of the array of needle bars.

Generally, the embroidery sewing machine additionally includes an embroidery frame which holds a work sheet such as fabric or leather into which the sewing machine forms stitches; a driven or movable frame to which the embroidery frame is secured; and an X-Y drive device which drives or moves the movable frame in an X direction and in a Y direction independently of each other. The Y direction is parallel to, e.g., the direction of extension of the sewing-head arm of the sewing machine. While the embroidery frame is moved in the horizontal plane defined by the X and Y directions, the sewing machine forms stitches into the work sheet held by the embroidery frame.

For forming an embroidery into a front part of a headgear such as a cap or a hat, a headgear holding device is used with the embroidery sewing machine, in such a manner that the headgear holding device is operatively connected to an X-drive and a Y-drive mechanism of the X-Y drive device of the sewing machine.

U.S. Pat. No. 4,665,844 discloses an example of the headgear holding device, which includes a base frame which can be guided in the Y direction; a rotatable frame which is supported by the base frame such that the rotatable frame is rotatable about an axis line parallel to the Y direction; and a headgear holder which holds a headgear into which the sewing machine forms stitches and which is detachably securable to the rotatable frame. This document additionally discloses another example of the headgear holding device, which includes a guide bar which is permanently fastened at one end thereof to the work table of the sewing machine; a rotatable frame which can be guided on the guide bar in the Y direction; a headgear holder which is detachably securable to the rotatable frame.

In the above-described first headgear holding device wherein the base frame is employed, the base frame is operatively connected to the Y-drive mechanism of the sewing machine, so that the base frame can be moved in the Y direction, while the rotatable frame (and headgear holder secured thereto) is operatively connected to the X-drive mechanism of the sewing machine via a motion converting mechanism, so that the rotatable member can be rotated about the axis line parallel to the Y direction.

In the first headgear holding device, a guiding device is additionally employed for guiding the base frame in the Y direction relative to the work table of the sewing machine. The guiding device includes a guide member extending in the Y direction; a support member supporting the guide member; and a plate member which can be guided by the guide member and which supports the base frame including a plurality of rollers.

In the first headgear holding device, a connecting device is further employed for connecting the base frame to the Y-drive mechanism of the sewing machine. The connecting device includes a Y-feed member which is fixed to the upper surface of the X-Y movable frame of the sewing machine. The base frame is operatively connected to the Y-feed member via various parts.

However, the conventional headgear holding devices suffer from various problems. For example, the guiding device has a complex construction needing many parts. Additionally it is very cumbersome and time-consuming to attach and remove the headgear holding device to and from the work table of the sewing machine.

Furthermore, it is not easy to connect and disconnect the base frame of the headgear holding device to and from the Y-drive mechanism of the sewing machine.

SUMMARY OF THE INVENTION

It is therefore an object of the present invention to provide a headgear holding apparatus which enjoys a simple construction and which is easily securable and detachable to and from an embroidery sewing machine. The present holding apparatus may hold any curved workpiece other than a headgear.

The above object has been achieved by the present invention, which provides a headgear holding apparatus for use with an embroidery sewing machine including a machine body having a sewing-bed arm, the apparatus comprising (a) a base structure, (b) a guiding device including a guide member, for guiding the base structure in a guiding direction, (c) a rotatable structure supported by the base structure such that the rotatable structure is rotatable about an axis line parallel to the guiding direction, (d) a headgear holder holding a headgear into which the sewing machine forms stitches, the headgear holder being detachably securable to the rotatable structure, and (e) the guide member of the guiding device being detachably securable to the machine body of the sewing machine such that the guide member extends substantially parallel to the sewing-bed arm of the sewing machine.

In the headgear holding apparatus constructed as described above, the guide member of the guiding device is detachably secured to the machine body of the sewing machine such that the guide member extends substantially parallel to the sewing-bed arm of the sewing machine. The base structure can be guided by the guiding device including the guide member, in the guiding direction. The rotatable structure is supported by the base structure such that the rotatable structure is rotatable about an axis line parallel to the guiding direction, and the headgear holder holding a headgear into which the sewing machine forms stitches, is detachably securable to the rotatable structure. The base structure, rotatable structure, and headgear holder are movable as a unit on the guiding member in the guiding direction, and simultaneously the rotatable structure and headgear holder are rotatable as a unit about the axis line parallel to the guiding direction, so that the sewing machine forms an embroidery into the headgear held by the headgear holder. Since the guide member of the guiding device is detachably securable to the machine body of the sewing machine, the present headgear holding apparatus can very easily and quickly attached and removed to and from the sewing machine.

According to a preferred feature of the present invention, the guide member of the guiding device comprises a guide bar including a guide portion having a constant cross-sectional shape over an entire length of the guide portion, the guide portion of the guide bar extending through the base structure, so that the base structure can be guided on the guide bar in the guiding direction. In this case, the guide portion of the guide bar of the guiding device may have a circular cross-sectional shape over an entire length thereof, the guiding device further comprising an inhibit mechanism which inhibits the base structure from rotating around the guide portion of the guide bar. Alternatively, it is possible to use a guide bar including a guide portion having a rectangular cross-sectional shape so that the base structure can be inhibited from rotating around the guide bar without employing an exclusive rotation inhibit mechanism.

According to another feature of the present invention, the guide bar of the guiding device is detachably securable to the machine body of the sewing machine by being inserted into an insertion hole formed in the machine body of the sewing machine. The guide bar inserted in the insertion hole may be secured by fastening a screw, for example.

According to yet another feature of the present invention, the headgear holding apparatus further comprises a connecting device which operatively connects the base structure to a first movable member of the sewing machine which is movable in a first direction, so that the connecting device transmits the movement of the first movable member to the base structure and thereby causes the base structure to be guided by the guiding device in the guiding direction.

According to a further feature of the present invention, the first movable member of the sewing machine is movable only in the first direction, and the guiding device can guide the base structure in the guiding direction parallel to the first direction. Since the first movable member is movable only in the first direction, the connecting device is movable only in the first direction, and transmits only the movement of the first movable member in the first direction, to the base structure.

According to another feature of the present invention, the connecting device comprises a clamp mechanism including a clamp lever for clamping and releasing the base structure to and from the first movable member of the sewing machine. By operating the clamp lever, the base structure can easily be clamped and released to and from the first movable member. In this case, the connecting device may further comprise a first connection member engageable with one of the base structure and the first movable member of the sewing machine, the clamp lever being manually operable for clamping and releasing the first connection member to and from the other of the base structure and the first movable member. The first movable member may have a receiving hole and an engaging hole communicating with the receiving hole and having an inner dimension smaller than an inner dimension of the receiving hole, and the clamp mechanism may further comprise a second connection member including a head portion having an outer dimension smaller than the inner dimension of the receiving hole and greater than the inner dimension of the engaging hole, and an axial portion extending from the head portion and having an outer dimension smaller than the inner dimension of the engaging hole, the axial portion of the second connection member being movably engaged with the first connection member engageable with the base structure, the clamp lever being pivotally connected to the axial portion of the second connection member, so that the clamp lever is manually operable for passing the head portion of the second connection member through the receiving hole of the first movable member and subsequently pivoting the clamp lever and thereby engaging the head portion with a part of the first movable member which part defines the engaging hole. The second connection member is released from the first movable member by carrying out the above steps reversely. Alternatively, the clamp mechanism may be constituted by (a) an engage member including (a1) a head portion and an (a2) axial portion extending from the head portion and fixed to the first movable member, and (b) a clamp lever pivotally connected to (c) the first connection member having (cl) a receiving hole receiving the head portion of the engage member and (c2) an engage hole engaging the head portion. In the latter case, the clamp lever is pivoted for engaging and disengaging with and from the head portion of the second connection member and thereby clamping and releasing the first connection member to and from the first movable member.

According to another feature of the present invention, the connecting device operatively connects the base structure to a lower surface of the first movable member of the sewing machine, so that a substantially entire portion of the connecting device is positioned under the first movable member.

According to another feature of the present invention, the base structure comprises a plurality of groups of support rollers which cooperate with each other to support the rotatable structure such that the rotatable structure is rotatable about the axis line and such that the rotatable structure is movable with the base structure on the guide member of the guiding device in the guiding direction. In this case, the groups of support rollers may comprise two pairs of support rollers, at least one pair of the two pairs of support rollers including at least one roller which is concentrically and rotatably supported by an eccentric axis member, the eccentric axis member being eccentrically fixed to a rotatable member which is rotatably supported by the base structure. The rotatable member may be adjusted, using, e.g. a nut, with respect to angular position or rotation amount relative to the base structure.

According to another feature of the present invention, the base structure further comprises a frame member having two arm portions each of which supports a corresponding one pair of the two pairs of support rollers, the two arm portions permitting the sewing-bed arm of the sewing machine to extend through between the two arm portions.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 5*b* is a cross-sectional view of a slide member secured to a connection member of the connecting device of FIG. 5*a.

DETAILED DESCRIPTION OF THE PREFERRED EMBODIMENTS

Figure 1:
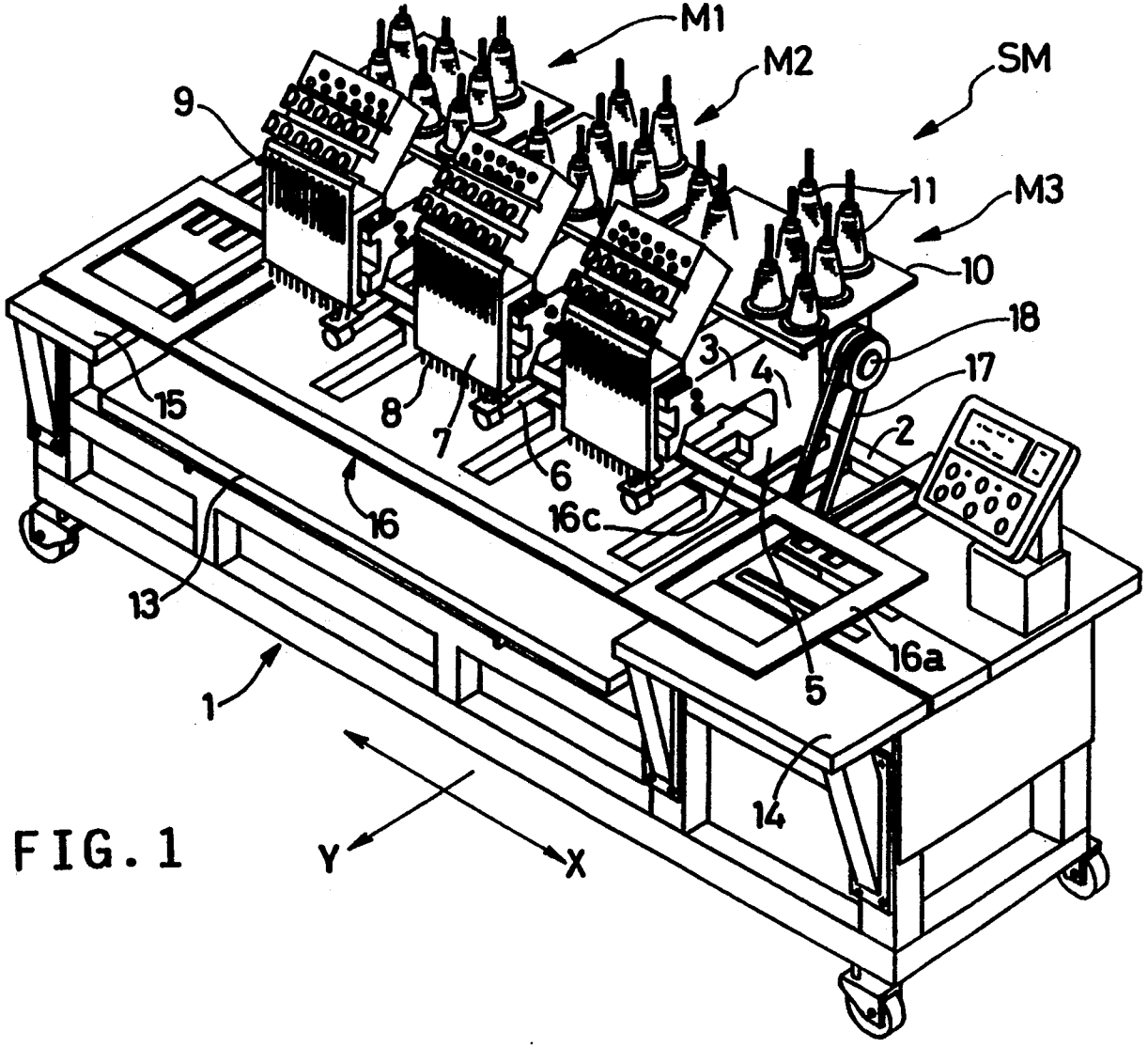
FIG. 1 is a schematic view of a multiple-head embroidery sewing machine, SM.

Referring first to FIG. 1, there is shown a multiple-head embroidery sewing machine, SM, which includes three multiple-needle sewing heads, M1, M2, M3, each of which has an identical construction. Each sewing head M1–M3 may be used with a headgear holding apparatus 20 (FIGS. 2 to 4) in accordance with the present invention, to form stitches of an embroidery into a headgear held by the apparatus 20. However, any curved workpiece such as a garment's sleeve other than a headgear may be held by the present holding apparatus 20.

Figure 2:
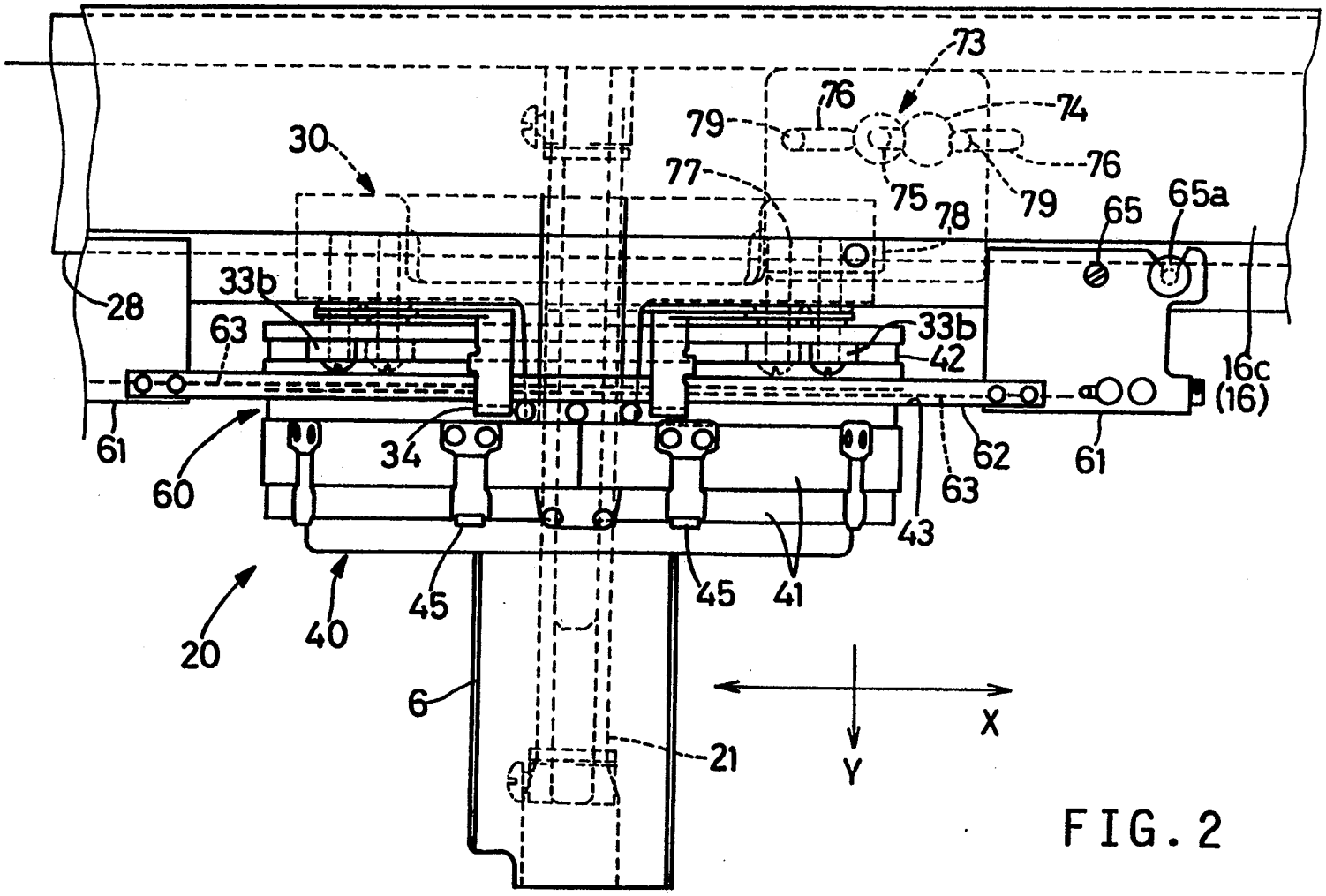
FIG. 2 is a plan view of a headgear holding apparatus embodying the present invention, showing the situation in which the headgear holding apparatus is secured to the sewing machine SM of FIG. 1.

The sewing machine SM includes a machine table 1 which is long in an X direction and short in a Y direction perpendicular to the X direction (the X and Y directions are indicated at arrows in FIGS. 1 and 2). On a rear portion of the machine table 1, there is disposed a base plate 2 which has an elongate rectangular shape extending in the X direction. On the base plate 2, there are provided the three multiple-needle sewing heads M1–M3 such that the three sewing heads M1–M3 are equidistant from each other in the X direction.

Each sewing head M1–M3 includes a sewing-head arm 3 which supports, at a free or front end thereof, a needle-bar housing 7 which accommodates twelve needle bars (not shown) arranged in an array in the X direction and twelve thread take-up levers 9 associated with the respective needle bars. The needle-bar housing 7 is displaceable, on the sewing-head arm 3, horizontally in the X direction, so that one of the twelve needle bars may be selected and brought into a sewing position where the selected needle bar is vertically reciprocatable and the thread take-up lever 9 associated therewith is vertically swingable, each in synchronism with the rotation of an upper drive shaft (not shown) extending in the sewing-head arm 3. The sewing position is aligned with a needle throat (not shown) formed in a front end portion of a sewing-bed arm 6 which has a generally cylindrical shape.

The sewing-head arm 3 of each sewing head M1–M3 extends, like a cantilever, horizontally from an upper end portion of an arm support 4 which extends vertically upward from a machine body or head base 5. The head base 5 is fixed to a top face of the base plate 2. The sewing-bed arm 6 has a generally cylindrical shape and extends from a front face of the head base 5. The sewing-bed arm 6 accommodates, in the front end portion thereof, a thread-loop catcher (not shown) which catches a loop of an embroidery thread conveyed by a sewing needle 8 secured to a lower end of a selected needle bar which is currently indexed at the sewing position of the sewing head M1–M3. The loop catcher is rotated by a lower drive shaft (not shown) extending in the sewing-bed arm 6.

As shown in FIG. 1, a sewing needle 8 is secured to each of the twelve needle bars of each sewing head M1–M3, and the twelve sewing needles 8 are respectively supplied with twelve color-different threads from twelve spool holder pins 11 fixed to corresponding spool holder bases 12. A desired one of the twelve different threads is selected by displacing the corresponding needle bar and needle 8 to the sewing position, and stitches are formed with the selected color thread into the headgear held by the holding apparatus 20, by cooperation of the selected needle 8 and the loop catcher provided in the sewing-bed arm 6. The above-mentioned upper and lower drive shafts are operatively connected to a common drive shaft 18, which is connected via a V belt 17 to a main motor (not shown) and is rotated by the main motor. The needle-bar housing 7 of each sewing head M1–M3 is displaced by an exclusive motor (not shown).

In front of the base plate 2, there is disposed a working table 13 which is movable upward and downward. On right and left sides of the working table 13, there are provided two side tables 14, 15. When the working table 13 is moved up to its upper position, the upper surface of the table 13 becomes level with the upper surfaces of the two side tables 14, 15 and the upper surface of the sewing-bed arm 6. An X-Y movable frame 16 extends over the right and left side tables 14, 15 in the X direction. The X-Y movable frame 16 includes a right frame portion 16*a* which is driven or moved by an X-direction feeding device in the X direction. A Y-feed member 28 (FIGS. 2 and 3) is disposed under, and engaged with, a rear frame portion 16*c* of the X-Y movable frame 16, and is driven or moved by a Y-direction feeding device only in the Y direction, so that the X-Y movable frame 16 engaged with the Y-feed member 28 is moved in the Y direction. Thus, the X-Y movable frame 16 is movable above the tables 13–15 by the X-direction and Y-direction feeding devices in the horizontal plane defined by the X and Y directions.

Next, there will be described the construction of the headgear holding apparatus 20, which is detachably securable to the head base 5 of each sewing head M1–M3 of the sewing machine SM.

Figure 3:
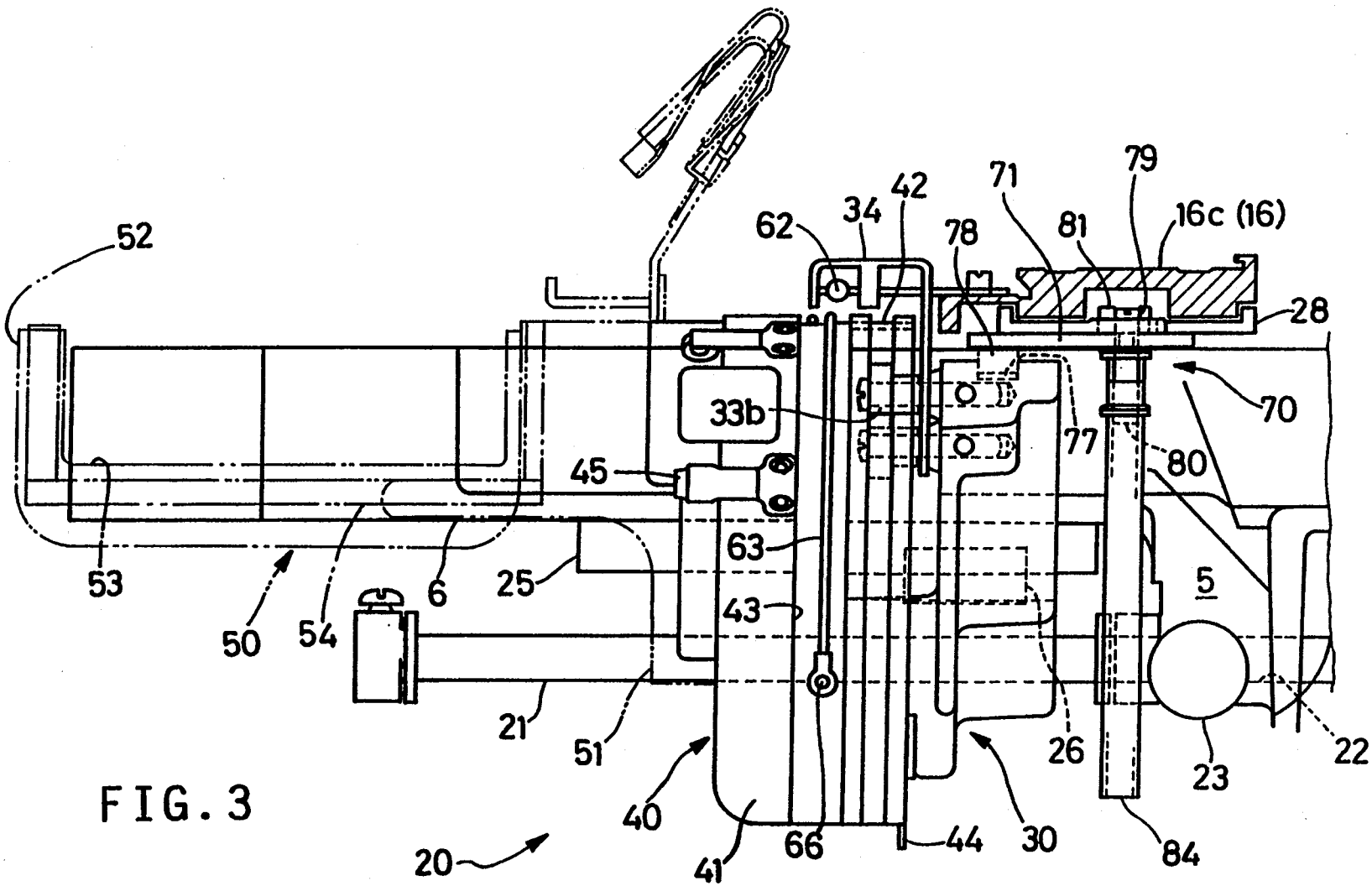
FIG. 3 is a side view of the headgear holding apparatus of FIG. 2.
Figure 4:
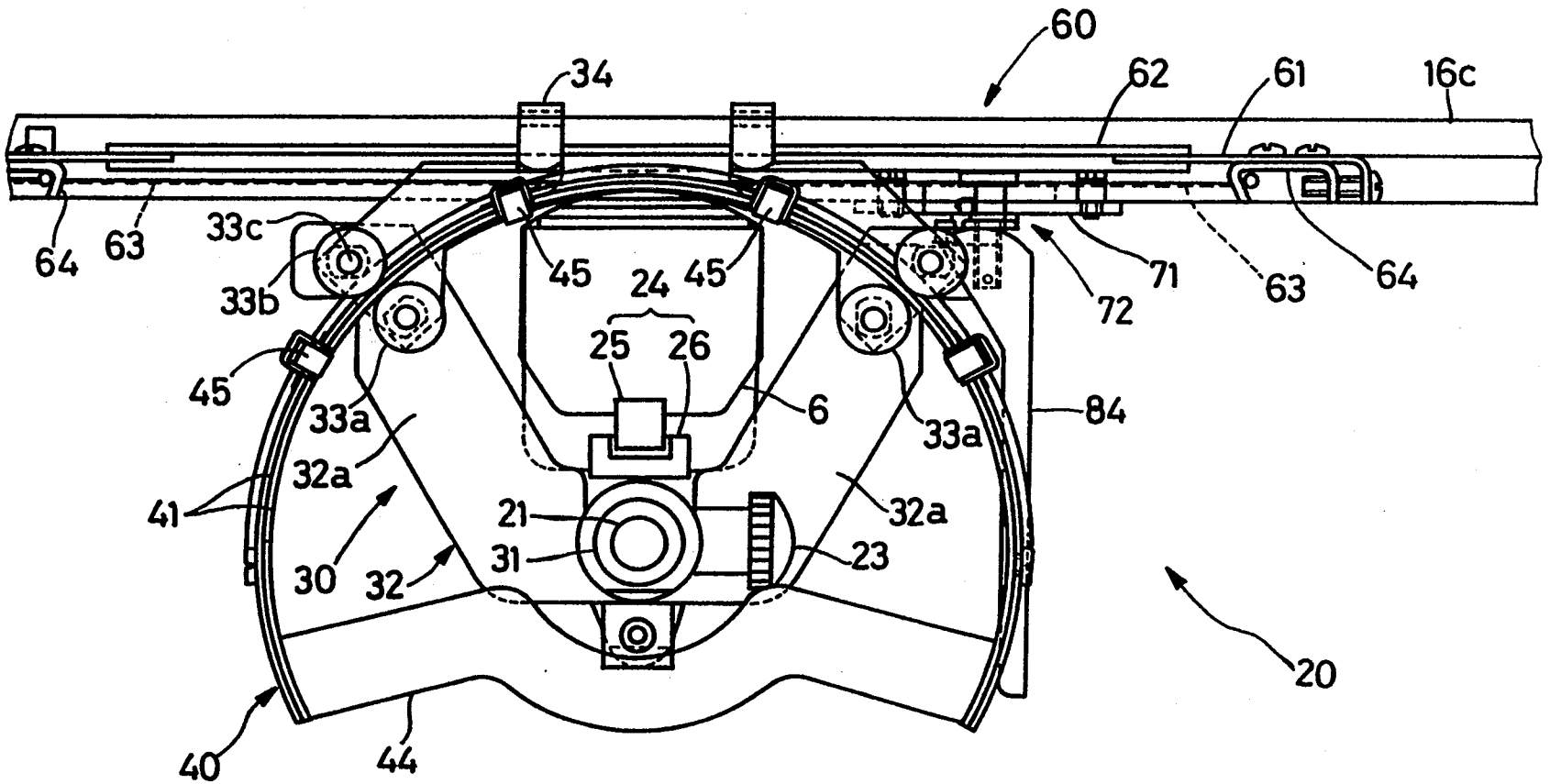
FIG. 4 is a front view of the headgear holding apparatus of FIG. 2.

As shown in FIGS. 2, 3, and 4, the headgear holding apparatus 20 includes (a) a cylindrical guide bar 21 which extends in the Y direction with the guide bar 21 being secured to the head base 5 of each sewing head SM1–SM3; (b) a base structure 30 which is supported by the guide bar 21 such that the base structure 30 can be guided, i.e., movable in the Y direction; (c) an inhibit mechanism 24 which inhibits the base structure 30 from rotating around the guide bar 21; (d) a rotatable structure 40 which is supported by the base structure 30 such that the rotatable structure 40 is rotatable about an axis line parallel to the Y direction (i.e., parallel to the guide bar 21) and such that the rotatable structure 40 is movable with the base structure 30 relative to the head base 5 in the Y direction; (e) a headgear holder 50 which holds a headgear such as a cap or a hat into which the sewing head M1–M3 of the sewing machine SM forms stitches and which is detachably securable to the rotatable structure 40; (f) a converting mechanism 60 which converts the X-direction movement of the X-Y movable frame 16 into the rotation of the rotatable structure 40 and headgear holder 50 about the above-mentioned axis line; and (g) a connecting device 70 which operatively connects the base structure 30 to the Y-feed member 28 which is engaged with a lower surface of the rear frame portion 16c of the X-Y movable frame 16 and which accordingly is movable with the frame 16 in the Y direction by the Y-direction feeding device. The Y-feed member 28 cannot, however, be moved in the X direction even when the X-Y movable frame 16 is moved in the X direction.

Each of the above-indicated elements (a) to (g) is described below in more detail.

As shown in FIG. 3, the element (a), i.e., guide bar 21 is detachably securable to the front face of the head base 5 of each sewing head M1–M3, in such a manner that the guide bar 21 is inserted rearward into an insertion hole 22 which is formed in the head base 5 so as to extend horizontally in the Y direction. The inserting of the guide bar 21 is stopped by abutment with the innermost wall defining the bottom of the insertion hole 22. The insertion hole 22 has a diameter substantially equal to an outer diameter of the cylindrical guide bar 21. The guide bar 21 inserted in the insertion hole 22 is fastened by a fastening member 23 such as a screw having a knob. Thus, the guide bar 21 is detachably secured to the head base 5 of the sewing head SM1–SM3.

As shown in FIG. 4, the element (b), i.e., base structure 30 includes, in a lower portion thereof, a fitting sleeve 31 which is externally fitable on the cylindrical guide bar 21 such that the sleeve 31 is slidable or movable on the guide bar 21 in the Y direction. The fitting sleeve 31 has an inner diameter substantially equal to the outer diameter of the cylindrical guide bar 21. The base structure 30 further includes a V-shaped frame 32 which is fixed at a bottom portion thereof to the fitting sleeve 31. The V-shaped frame 32 includes two arm portions **32*a*, 32*a* each of which supports at a free end portion thereof a pair of support rollers 33*a*, 33*b* which cooperate with each other to externally and internally support the rotatable structure 40 such that the rotatable structure 40 is rotatable about an axis line parallel to the Y direction. The two pairs of support rollers 33*a*, 33*b* of the base structure 30 cooperate with each other to rotatably support the rotatable structure 40**.

The outer roller **33*b* of each pair of support rollers 33*a*, 33*b* is concentrically and rotatably supported by one end of an eccentric axis member 33*c* which is eccentrically fixed at the other end to a rotatable member rotatably supported by the corresponding arm portion 32*a*, so that the outer roller 33*b* may be re-positioned relative to the corresponding inner roller 33*a* in a direction perpendicular to the Y direction by rotating the rotatable member supporting the eccentric axis member 33*c*. The rotatable member supporting the eccentric axis 33*c* may be adjusted at any angular position or rotation amount relative to the corresponding arm portion 32*a*. The position of the outer roller 33*b* relative to the inner roller 33*a* may be finely adjusted in a direction perpendicular to the Y direction, by loosening a fastening member such as a nut for fastening the rotatable member, rotating the rotatable member (and the eccentric axis member 33*c*) by an appropriate angular amount, and fastening the rotatable member with the nut. This fine adjustment of the outer roller 33*b* ensures that the outer roller 33*b* cooperates with the inner roller 33*a* to support the rotatable structure 40 in an optimum manner in which a front part of the headgear held by the holder 50 is positioned at an optimum level with respect to the sewing-bed arm 6, even if the holder 50** may be changed with another holder having a slightly different radius of curvature.

The inner roller **33*a* of each pair of support rollers 33*a*, 33*b* may, or may not, be supported by an eccentric axis member similar to the eccentric axis member 33*c* of the outer roller 33*b*. Two fixtures 34, 34 are fixed to the two arm portions 32*a*, 32*a*, respectively, each via the axis members 33*c* of the support rollers 33*a*, 33*b*. Each fixture 34 has a generally L-shaped cross section as viewed in FIG. 3**.

As shown in FIG. 4, the element (c), i.e., inhibit mechanism 24 includes a key member 25 which is fixed to a bottom face of the sewing-bed arm 6 and extends in the Y direction. The inhibit mechanism 24 additionally includes a grooved member 26 which is fixed to a top face of the bottom portion of the V-shaped frame 32 of the base structure 30 and which has a groove engageable with the key member 25 when the guide bar 21 and the base structure 30 fitting on the guide bar 21 are secured to the head base 5 of the sewing head M1–M3. The grooved member 26 engaged with the key member 25 is slidable or movable relative to the key member 25, so that the engaged key and grooved members 25, 26 permit the V-shaped frame 32 (and fitting sleeve 31) to be guided on the guide bar 21 in the Y direction but do not permit the V-shaped frame 32 to rotate around the guide bar 21 extending in the Y direction. However, the key member 25 may be fixed to the base structure 30 and the grooved member 26 may be fixed to the sewing-bed arm 6.

As shown in FIG. 3, the element (d), i.e., rotatable structure 40 includes an arcuate member 41 which has an arcuate cross-sectional shape extending over about 240°. The arcuate member 41 has, in an outer circumferential surface thereof, a roller guide groove 42 in which the outer rollers **33*b* of the two pairs of support rollers 33*a*, 33*b* fit, and a wire guide groove 43 which receives two connection wires 63, 63 of the converting mechanism 60**.

Lower ends of right and left halves of the arcuate member 41 are connected to each other by a reinforcement plate 44 (FIG. 4). Four securing rollers 45 are fixed to the outer surface of the arcuate member 41 via respective spring members. The headgear holder 50 is detachably securable to the rotatable structure 40 such that an arcuate engaging portion 51 of the headgear holder 50 externally fits on an arcuate engaging portion of the arcuate member 41 against the elastic biasing forces of the spring members associated with the securing rollers 45. The securing rollers 45 are held in engagement with securing holes (not shown) formed through the thickness of the engaging portion 51 of the headgear holder 50.

The element (e), i.e., headgear holder 50 has a holder member (51, 52) including the arcuate engaging portion 51 which externally fits on the arcuate engaging portion of the arcuate member 41 of the rotatable structure 40, and a frame portion 52 which extends frontward from the arcuate engaging portion 51. The inner radius of curvature of the engaging portion 51 is substantially equal to the outer radius of curvature of the engaging portion of the arcuate member 41. The engaging portion 51 has the four securing holes which engage the four securing rollers 45 of the arcuate member 41, respectively. The frame portion 52 has an opening 53 which cooperates with a retainer member 54 formed of a spring material to retain the headgear in position.

As shown in FIG. 2, the element (f), i.e., converting mechanism 60 includes a pair of right and left end plates 61, 61 which are detachably securable to an upper surface of the rear frame portion 16c of the X-Y movable frame 16, with a predetermined distance being provided between the two end plates 61, 61 secured to the rear frame portion 16c with respective vises 65a, 65a each with a knob. The converting mechanism 60 additionally includes a connection rod 62 which connects the two end plates 61, 61, and the two connection wires 63, 63.

As shown in FIG. 4, one of the two connection wires 63, 63 is connected at a left end thereof to a metal member 64 fixed to the left end plate 61, and the same 63 is guided at an intermediate portion thereof by the wire guide groove 43 of the arcuate member 41 of the rotatable structure 40 to a right-side portion of the arcuate member 41, and is fixed at a right end thereof to a right end portion of the wire guide groove 43 with a vis 66 (FIG. 3). Meanwhile, the other connection wires 63 is connected at a right end thereof to a metal member 64 fixed to the right end plate 61, the same 63 is guided at an intermediate portion thereof by the wire guide groove 43 of the arcuate member 41 to a left-side portion of the arcuate member 41, and is fixed at a left end thereof to a left end portion of the wire guide groove 43 with a vis (not shown).

When the X-Y movable frame 16 or rear frame portion 16c is moved leftward in the X direction by the X-direction feeding device, the Y-feed member 28 cannot be moved in the Y direction, but the rotatable structure 40 is rotated about the center of curvature of the arcuate member 41, counterclockwise as viewed in FIG. 4. Meanwhile, the rotatable structure 40 is rotated clockwise when the X-Y movable frame 16 is moved rightward in the X direction. The angular amount of rotation of the rotatable structure 40 is directly proportional to the amount of the rightward or leftward movement of the X-Y movable frame 16 in the X direction.

As shown in FIG. 3, the element (g), i.e., connecting device 70 includes a connection member 71 which is engageable with the base structure 30 to operatively connect the base structure 30 to the Y-feed member 28; and a clamping mechanism 72 which is associated with the connection member 71 and is manually operable for clamping the connection member 71 to, and releasing the same 71 from, the Y-feed member 28.

With the headgear holding apparatus 20 being secured to the head base 5 of the sewing head M1–M3, the connection member 71 is positioned above the base structure 30 and below the Y-feed member 28.

As shown in FIG. 2, the Y-feed member 28 has an engage region 73 which is engageable with the connection member 71. The engage region 73 includes a circular hole 74, a narrow elongate hole 75 which communicates with a left end of the circular hole 74 and extends in the X direction, and a pair of elongate slits 76, 76 which are provided on both sides of the circular and elongate holes 74, 75 and each of which extends in the X direction.

As shown in FIG. 3, a slide member 78 is secured to a front end portion of a lower surface of the connection member 71. The slide member 78 is engageable with an engage groove 77 which is formed in a top face of the right arm 32a of the V-shaped frame 32 of the base structure 30 and extends in the X direction. Additionally, a pair of right and left positioning pins 79, 79 (FIG. 2) are fixed to an upper surface of the connection member 71. The two pins 79, 79 are engageable with the two elongate slits 76, 76 of the engage region 73 of the Y-feed member 28, respectively.

Figure 5A:
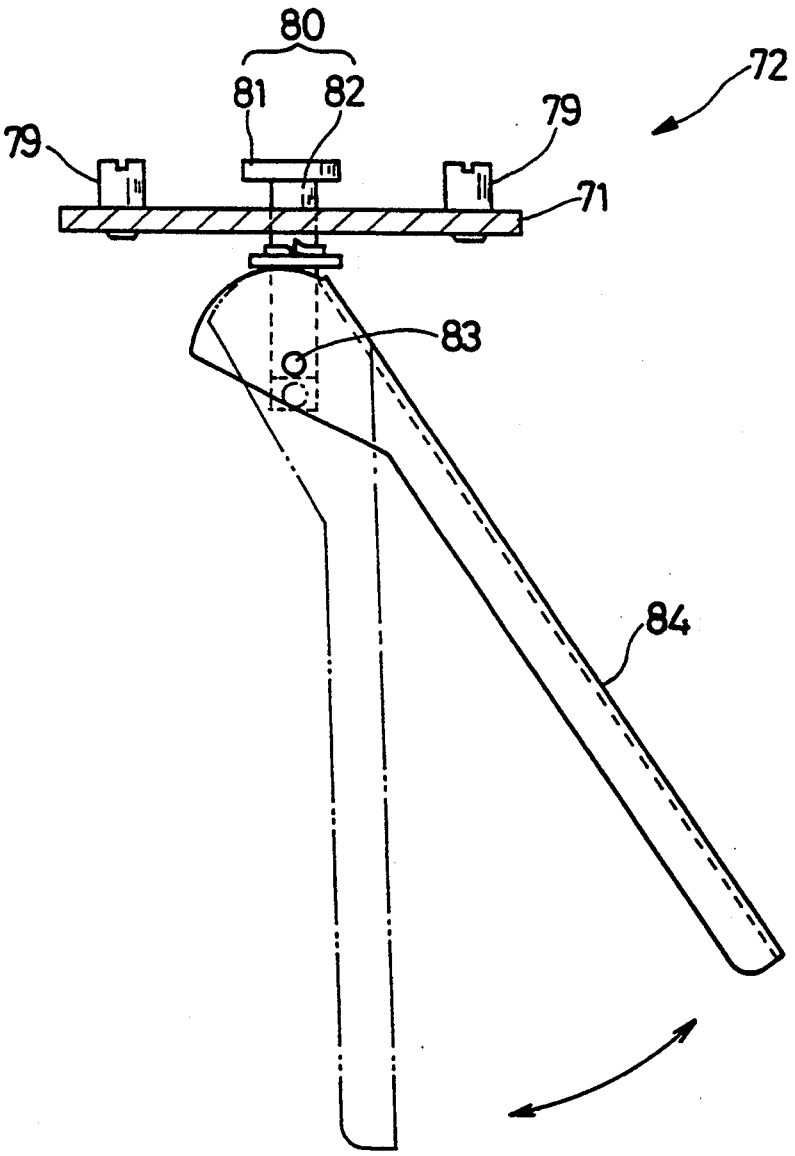
FIG. 5*a* is a cross-sectional view of a connecting device of the headgear holding apparatus of FIG. 2.

The clamping mechanism 72 associated with the connection member 71 is shown in FIG. 5a. The clamping mechanism 72 includes a second connection member or axial member 80 which has a head portion 81 engageable with the the elongate hole 75 of the Y-feed member 28 and also has an axial portion 82 extending downward from the head portion 81. The clamping mechanism 72 further includes a hand lever 84 which is pivoted to a lower end portion of the axial portion 82 of the axial member 80 with a pin 83 extending in the Y direction. The hand lever 84 is pivotable about the pin 83 for selectively moving the axial member 80 to one of (a) a clamping position where the head portion 81 of the axial member 80 engages the engage region 73 of the Y-feed member 28 so that the first connection member 71 is held in engagement with the Y-feed member 28, and (b) a releasing position where the head portion 81 is kept away upward from the clamping position.

As shown in FIG. 5a, the hand lever 84 has a curved top end. The clamping and releasing positions of the axial member 80, i.e., clamping mechanism 72 are illustrated in broken and solid lines, respectively.

Figure 5B:
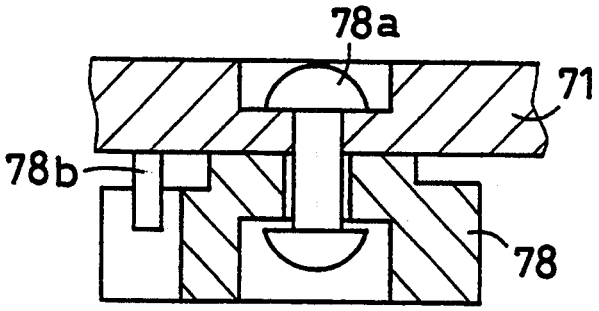
Figure 5C:
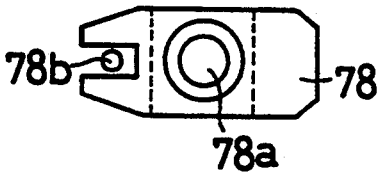
* and FIG. 5*c* is a bottom view of the slide member of FIG. 5*b*.

As shown in FIGS. 5b and 5c, the slide member 78 is secured to the first connection member 71 with a rivet 78a such that the slide member 78 is slightly pivotable about the rivet 78a and the pivotal movement of the slide member 78 is limited by a pin 78b fixed to the first connection member 71.

The first connection member 71 is detachably secured to the engage region 73 of the Y-feed member 28 by operating the clamping mechanism 72, specifically, hand lever 84, in such a manner that, with the axial member 80 being held in the releasing position, the head portion 81 of the axial member 80 and the positioning pins 79, 79 of the connection member 71 are inserted into the circular hole 74 and the slits 76, 76 of the engage region 73, respectively, subsequently the slide member 78 of the connection member 71 is moved leftward in the engage groove 77 of the right arm 32a of the V-shaped frame 32, so as to bring the axial portion 82 of the axial member 81 into engagement with the elongate hole 75, and then the head portion 81 of the axial member 80 is moved downward to, and held in, the clamping position.

Hereinafter, there will be described the operations and functions of the headgear holding apparatus 20 constructed as described above.

The above-described elements (b), (d), (e), and (f), i.e., base structure 30, rotatable structure 40, headgear holder 50, and converting mechanism 60 may be assembled into a headgear holding unit which is detachably securable to each of the sewing heads M1–M3 of the sewing machine SM in such a manner as described below.

First, the guide bar 21 is removed from the insertion hole 22 of the head base 5 of the sewing head M1–M3, by loosening the fastening member 23. Second, the clamping mechanism 72 is manually placed in the releasing position by pivoting the hand lever 84 as indicated in solid line in FIG. 5a, and the slide member 78 is put in at a right end of the engage groove 77 (FIG. 3) of the base structure 30. In this situation, the headgear holding unit is positioned in front of the sewing head M1–M3, subsequently the guide bar 21 is inserted into the fitting sleeve 31 of the base structure 30 and then into the insertion hole 22 of the head base 5 of the sewing head M1–M3, and then the fastening member 23 is fastened to tightly secure the guide bar 21 to the head base 5. Simultaneously, the grooved member 26 of the base structure 30 is held in engagement with the key member 25 fixed to the sewing-bed arm 6.

After the axial member 80 of the clamping mechanism 72 is positioned directly below the circular hole 74 of the Y-feed member 28, the first connection member 71 is moved upward by moving the clamping mechanism 72 upward, specifically, the hand lever 84 upward, so that the head portion 81 of the axial member 80 is inserted into the circular hole 74 and the positioning pins 79, 79 are inserted into the elongate slits 76, 76, respectively. Subsequently, the first connection member 71 is moved leftward by an appropriate distance, so that the axial portion 82 of the axial member 80 is brought into engagement with the elongate hole 75 of the Y-feed member 28. Next, the axial member 80 is moved down to, and held in, the clamping position by pivoting the hand lever 84 as indicated in broken line in FIG. 5*a*, so that the first connection member 71 and the axial member (second connection member) 80 are tightly secured to the Y-feed member 28 and so that the first connection member 71 and the base structure 30 may be moved as a unit in the Y direction because of the engagement of the slide member 78 and the engage groove 77.

The end plates 61, 61 of the converting mechanism 60 are placed in position on the upper surface of the rear frame portion 16*c* of the X-Y movable frame 16 with the help of respective positioning pins 65, 65, and then are tightly secured to the rear frame portion 16*c* by screwing the knobs of the respective vises 65*a*, 65*a*.

Detaching of the headgear holding unit from the sewing head M1–M3 is carried out by effecting the above-described steps reversely.

It emerges from the foregoing description that, in the present embodiment, the headgear holding apparatus 20 is detachably securable to the sewing machine SM by using the least number of vises or bolts, i.e., only two vises 65*a*, 65*a* used for securing the two end plates 61, 61 to the X-Y movable frame 16. It is however necessary to fasten the fastening member 23 for securing the guide bar 21 to the sewing machine SM.

The guide bar 21 may be detached from the head base 5 of the sewing machine SM while the headgear holding apparatus 20 is not in use with the sewing machine SM. In this situation, the guide bar 21 does not interfere with other sewing operations on the sewing machine SM, e.g., sewing operation carried out on a garment's sleeve having a considerably small diameter held by a pair of support arms each extending like a cantilever from the head base 5.

The rotatable structure 40 of the headgear holding unit is rotatably and linearly movably supported on the single guide bar 21. Thus, the construction of the structure necessary for supporting the headgear holding unit is simplified, and the manner of attaching and removing of the headgear holding apparatus 20 to and from the sewing head M1–M3 is also simplified.

Furthermore, the clamping mechanism 72 of the connecting device 70 enables easy clamping and releasing of the first connection member 71 to and from the Y-direction feed member 28 disposed under the Y-Y movable frame 16. For carrying out the clamping and releasing operations, it is not necessary to use any additional tools.

Since the Y-feed member 28 and the base structure 30 operatively connected thereto are not movable relative to each other in the X direction even when the X-Y movable frame 16 is moved in the X direction, the construction and size of the connecting device 70 is simplified and reduced.

Even if the hand lever 84 of the clamping mechanism 72 has a comparatively large size, the hand lever 84 does not interfere with operator's work or sight on the sewing machine SM, since the hand lever 84 is positioned below the Y-feed member 28 with the headgear holding apparatus 20 being secured to the sewing machine SM.

While the present invention has been described in its preferred embodiment, it is to be understood that the present invention may otherwise be embodied.

For example, while in the illustrated embodiment the two connection wires 63, 63 are used, it is possible to employ a single connection wire which is wound around the arcuate member 41 of the rotatable structure 40 in such a manner that the single wire connects the left end plate 61, right vis 66, left vis (not shown), and right end plate 61 in the order of description.

As suggested in the foregoing description, it is possible that the inner roller 33*a* of one or each of the two pairs of support rollers 33*a*, 33*b* of the base structure 30 be fixed to an eccentric axis member similar to the eccentric axis member 33*c* of the outer roller 33*a*. In this case, the inner roller 33*a* can be finely adjusted relative to the corresponding outer roller 33*b*, so that the rotation axis line of the rotatable structure 40 supported on the base structure 30 may be finely adjusted upward and downward and leftward and rightward in a plane perpendicular to the Y direction without having to changing the position of securing (i.e., insertion) of the guide bar 21 to the sewing head M1–M3. Therefore, various arcuate members (41) having different radii of curvature may be used with the same base structure 30, so that various headgears of different sizes may be held by the holding apparatus 20.

However, the base structure 30 may be changed with another base structure for accommodating a large difference in size or diameter of headgears which may not be accommodated by the small adjustments of the support rollers 32*a*, 32*b*.

It is to be understood that the present invention may be embodied with other changes, improvements, and modifications that may occur to those skilled in the art without departing from the spirit and scope of the invention defined in the appended claims.

What is claimed is:

1. A headgear holding apparatus for use with an embroidery sewing machine including a machine body having a sewing-bed arm, the apparatus comprising:

a base structure;

a guiding device including a guide member, for guiding said base structure in a guiding direction;

a rotatable structure supported by said base structure such that said rotatable structure is rotatable about an axis line parallel to said guiding direction;

a headgear holder holding a headgear into which the sewing machine forms stitches, said headgear holder being detachably securable to said rotatable structure; and said guide member of said guiding device being detachably secured to the machine body of the sewing machine and extending in the guiding direction substantially parallel to the sewing-bed arm of the sewing machine, said base structure being supported on the guide member and being movable relative to the guide member in the guiding direction.

2. A headgear holding apparatus according to claim 1, wherein said guide member of said guiding device comprises a guide bar including a guide portion having a constant cross-sectional shape over an entire length of said guide portion, said guide portion of said guide bar extending through said base structure.

3. A headgear holding apparatus according to claim 2, wherein said guide portion of said guide bar of said guiding device has a circular cross-sectional shape over an entire length thereof, said guiding device further comprising an inhibit mechanism which inhibits said base structure from rotating around said guide portion of said guide bar.

4. A headgear holding apparatus according to claim 3, wherein said inhibit mechanism of said guiding device comprises:

a key member fixed to one of said base structure and the sewing-bed arm of the sewing machine; and a grooved member having a groove and fixed to the other of said base structure and the sewing-bed arm, said groove of said grooved member being engageable with said key member so that the key and grooved members when engaged inhibit said base structure from rotating around said guide portion of said guide bar and permit said base structure to move on said guide bar in said guiding direction.

5. A headgear holding apparatus according to claim 3, wherein said base structure comprises a fitting sleeve having an inner diameter substantially equal to an outer diameter of said circular cross-sectional shape of said guide portion of said guide bar, said fitting sleeve being fitable on said guide portion of said guide bar.

6. A headgear holding apparatus according to claim 1, wherein said guide member is detachably secured to the machine body of the sewing machine by being inserted into an insertion hole formed in the machine body.

7. A headgear holding apparatus according to claim 1, further comprising a connecting device which operatively connects said base structure to a first movable member of the sewing machine which is movable in a first direction, so that said connecting device transmits the movement of the first movable member to said base structure and thereby causes said base structure to be guided by said guiding device in said guiding direction.

8. A headgear holding apparatus according to claim 7, wherein the first movable member of the sewing machine is movable only in the first direction, said guiding device guiding said base structure in said guiding direction parallel to said first direction.

9. A headgear holding apparatus according to claim 7, wherein said connecting device comprises a clamp mechanism including a clamp lever for clamping and releasing said base structure to and from the first movable member of the sewing machine.

10. A headgear holding apparatus according to claim 9, wherein said connecting device further comprises a first connection member engageable with one of said base structure and the first movable member of the sewing machine, said clamp lever being manually operable for clamping and releasing said first connection member to and from the other of said base structure and the first movable member.

11. A headgear holding apparatus according to claim 10, wherein the first movable member of the sewing machine has a receiving hole and an engaging hole communicating with said receiving hole and having an inner dimension smaller than an inner dimension of the receiving hole, said clamp mechanism further comprising a second connection member including a head portion having an outer dimension smaller than the inner dimension of the receiving hole and greater than the inner dimension of the engaging hole, and an axial portion extending from said head portion and having an outer dimension smaller than the inner dimension of said engaging hole, said axial portion of said second connection member being movably engaged with said first connection member engageable said base structure, said clamp lever being pivotally connected to said axial portion of said second connection member, so that said clamp lever is manually operable for passing said head portion of said second connection member through said receiving hole of said first movable member and subsequently pivoting said clamp lever and thereby engaging said head portion with a part of the first movable member which part defines said engaging hole.

12. A headgear holding apparatus according to claim 7, wherein said connecting device operatively connects said base structure to a lower surface of the first movable member of the sewing machine, so that substantially an entire portion of said connecting device is positioned under the first movable member.

13. A headgear holding apparatus according to claim 7, further comprising a transmitting mechanism which is detachably securable to a second movable member of the sewing machine which is movable in a second direction different from the first direction in which the first movable member is movable, said transmitting mechanism converting the movement of the second movable member to the rotation of said rotatable structure about said axis line.

14. A headgear holding apparatus according to claim 1, wherein said base structure comprises a plurality of groups of support rollers which cooperate with each other to support said rotatable structure such that said rotatable structure is rotatable about said axis line and such that said rotatable structure is movable with said base structure along said guide member of said guiding device in said guiding direction.

15. A headgear holding apparatus according to claim 14, wherein said groups of support rollers comprise two pairs of support rollers, at least one pair of said two pairs of support rollers including at least one roller which is concentrically and rotatably supported by an eccentric axis member, said eccentric axis member being eccentrically fixed to a rotatable member which is rotatably supported by said base structure.

16. A headgear holding apparatus according to claim 15, wherein said base structure further comprises a frame member having two arm portions each of which supports a corresponding pair of said two pairs of support rollers, said two arm portions permitting the sewing-bed arm of the sewing machine to extend through between the two arm portions.

17. A headgear holding apparatus according to claim 1, wherein said rotatable structure comprises an arcuate member including a first arcuate engaging portion, said headgear holder including a second arcuate engaging portion, one of inner and outer radii of curvature of said first arcuate engaging portion being substantially equal to one of inner and outer radii of curvature of said second arcuate engaging portion, said headgear holder being secured to said arcuate member by engaging said first and second arcuate engaging portions with each other.

18. A headgear holding apparatus according to claim 1, wherein said rotatable structure comprises a securing mechanism which detachably secures said headgear holder to said rotatable structure.

19. A headgear holding apparatus according to claim 1, wherein said headgear holder comprises:

a holder member having an opening; and a retainer member which cooperates with said holder member to retain the headgear into which the sewing machine forms stitches.

* * * * *